US011564510B1

(12) United States Patent
Fulks

(10) Patent No.: US 11,564,510 B1
(45) Date of Patent: Jan. 31, 2023

(54) SHELF ALIGNMENT GUIDE SYSTEM

(71) Applicant: Jayson Emmett Fulks, Arlington, TX (US)

(72) Inventor: Jayson Emmett Fulks, Arlington, TX (US)

( * ) Notice: Subject to any disclaimer, the term of this patent is extended or adjusted under 35 U.S.C. 154(b) by 0 days.

(21) Appl. No.: 17/209,856

(22) Filed: Mar. 23, 2021

Related U.S. Application Data

(63) Continuation of application No. 16/526,189, filed on Jul. 30, 2019, now Pat. No. 10,980,361.

(60) Provisional application No. 62/734,715, filed on Sep. 21, 2018.

(51) Int. Cl.
*A47F 7/02* (2006.01)
*A47F 11/10* (2006.01)
*A47B 81/00* (2006.01)

(52) U.S. Cl.
CPC ..... *A47F 7/021* (2013.01); *A47B 81/00* (2013.01); *A47F 11/10* (2013.01)

(58) Field of Classification Search
CPC ..... A47F 7/021; A47F 7/0243; A47F 7/03; A47F 11/10; A47B 81/00
USPC ..... 211/85.1
See application file for complete search history.

(56) References Cited

U.S. PATENT DOCUMENTS 1,492,113 A * 4/1924 Welsh ..... A47F 7/021 206/5
1,516,888 A * 11/1924 Mulnix ..... A47F 7/021 248/450
1,529,347 A * 3/1925 Dawson ..... A47F 7/021 248/450
2,930,567 A * 3/1960 Lloyd-Young ..... A47F 7/021 248/309.1
3,040,881 A * 6/1962 McNeill ..... A47F 7/021 211/85.1
3,123,208 A * 3/1964 Barnum et al. ..... B65D 5/5213 206/748
3,333,709 A * 8/1967 Leblanc ..... A47F 7/021 211/85.1
3,351,208 A * 11/1967 Siegel ..... A47F 7/021 211/85.1
3,836,007 A * 9/1974 Rosenwein ..... A47F 7/021 211/85.1
3,857,482 A * 12/1974 Shelton ..... B65D 21/0204 206/558
3,858,726 A * 1/1975 Rosenwein ..... A47F 7/021 211/85.1
3,891,092 A * 6/1975 Surrette ..... A47F 7/021 211/85.1
3,924,750 A * 12/1975 Dunchock ..... A47F 7/021 211/85.1
4,084,700 A * 4/1978 Dunchock ..... A47F 7/021 211/41.1

(Continued)

FOREIGN PATENT DOCUMENTS

DE 3143256 A1 * 5/1983 ..... A47F 7/021
DE 3815889 A1 * 11/1989 ..... A47F 7/021

*Primary Examiner* — Stanton L Krycinski
(74) *Attorney, Agent, or Firm* — Leavitt Eldredge Law Firm

(57) ABSTRACT

A shelf alignment guide system includes a first substrate with one or more channels disposed on the top surface of the substrate, the one or more channels to hold eyeglasses; a light strip secured to the first substrate; the one or more channels are curved to align with the eyeglasses.

10 Claims, 3 Drawing Sheets

(56) References Cited

U.S. PATENT DOCUMENTS

| | | | | | |
|---|---|---|---|---|---|
| 4,204,602 | A * | 5/1980 | Dunchock | A47F 7/021 | 211/85.1 |
| 4,890,745 | A * | 1/1990 | Holden | A47F 7/021 | 211/85.1 |
| 5,819,957 | A * | 10/1998 | Hahn | A47F 7/021 | 211/85.1 |
| 6,880,710 | B1 * | 4/2005 | Oliveras | A45C 11/04 | 206/5 |
| D533,736 | S * | 12/2006 | Raile | D6/682.2 | |
| D534,016 | S * | 12/2006 | Raile | D6/682.2 | |
| 7,147,113 | B2 * | 12/2006 | Obstfeld | A47F 7/021 | 211/85.1 |
| D536,905 | S * | 2/2007 | Raile | D6/682.2 | |
| D538,067 | S * | 3/2007 | Raile | D6/682 | |
| D538,555 | S * | 3/2007 | Raile | D6/682.2 | |
| 7,188,739 | B1 * | 3/2007 | Raile | A45C 11/04 | 211/85.1 |
| 8,135,482 | B2 * | 3/2012 | Caldwell | G09F 9/30 | 700/60 |
| 8,994,798 | B2 * | 3/2015 | Trinh | H04N 13/359 | 348/54 |
| 9,408,480 | B2 * | 8/2016 | O'Toole | A47F 7/021 | |
| 10,278,523 | B2 * | 5/2019 | Ringel | A47B 57/34 | |
| 10,485,362 | B2 * | 11/2019 | Pintur | A47F 7/021 | |
| 2005/0055859 | A1 * | 3/2005 | Grablick | B65D 73/0028 | 40/600 |
| 2017/0123450 | A1 * | 5/2017 | Mittelman | G06F 1/3265 | |
| 2018/0263381 | A1 * | 9/2018 | Roxe | A47F 5/02 | |
| 2019/0261788 | A1 * | 8/2019 | Ringel | A47B 57/10 | |

* cited by examiner

SHELF ALIGNMENT GUIDE SYSTEM

BACKGROUND

1. Field of the Invention

The present invention relates generally to shelves and shelving systems used at retail locations for the display of products and specifically to systems for the rapid placement and presentation of product.

2. Description of Related Art

Display racks and shelves are known to be used to promote and introduce products available for purchase. In eyewear stores the frames of glasses are displayed to enable the customers to try them on to check the feel and the appearance. A common problem associated with said shelves is their limited efficiency. When the frames are pulled from the shelves and used, they are most often not returned and aligned to the position they were in before use or testing by customers. This creates extra work for the retail staff who constantly re-adjust the products of said eyewear store after use.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
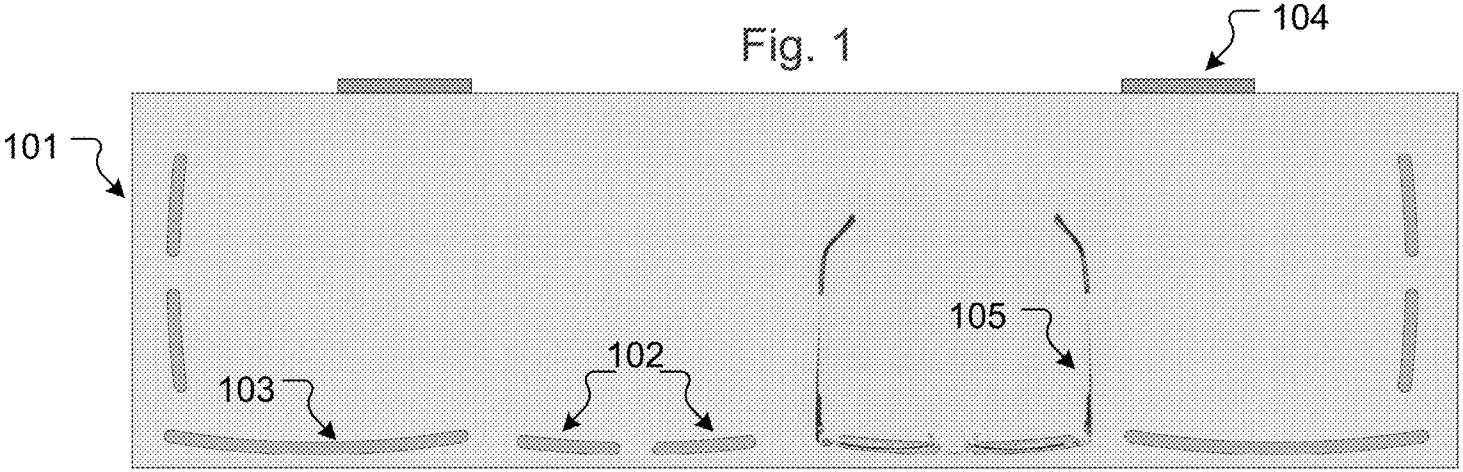
FIG. 1 is a top view of the shelf alignment guide system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
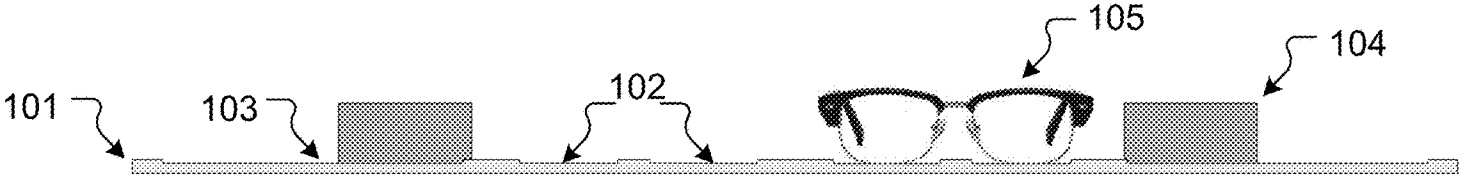
FIG. 2 is a front view of the shelf alignment guide system.
Figure 3:
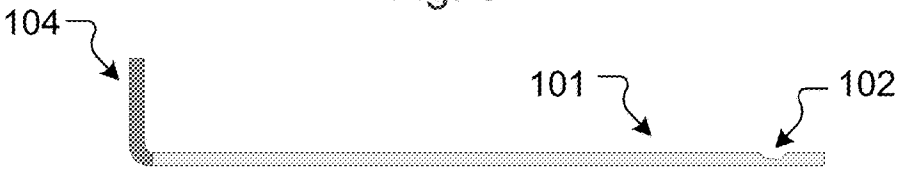
FIG. 3 is a side view of the shelf alignment system.
Figure 4:
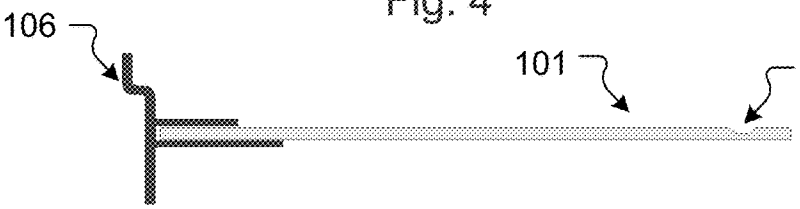
FIG. 4 is a side view of the shelf alignment system and mounted bracket 106 for slat wall or grid wall insertion.
Figure 5:
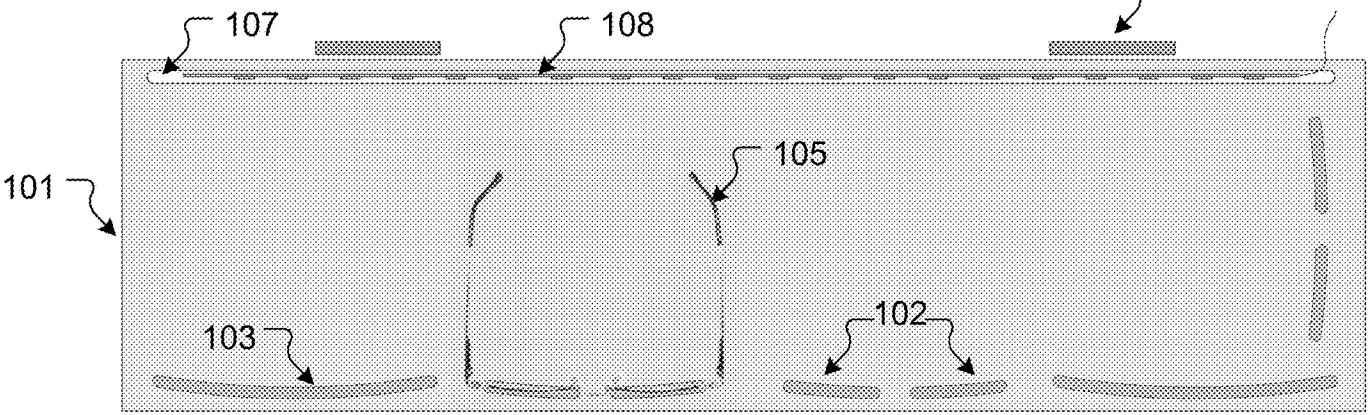
FIG. 5 is a top view with integrated channel 107 and inserted LED light strip 108.
Figure 6:
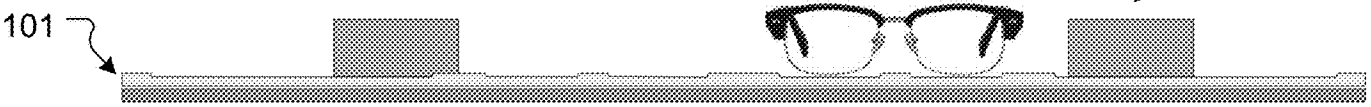
FIG. 6 is a front view with under-mounted or attached supporting panel 109.
Figure 7:
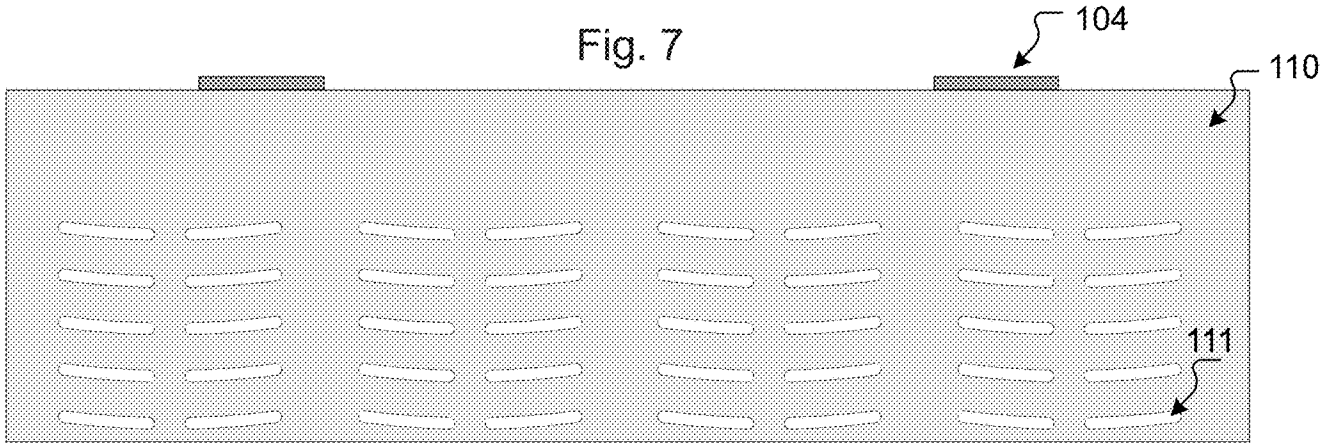
FIG. 7 is a top view of third substrate 110 that comprises multiple cut-through channels 111 to be mounted or laid on top of said first substrate/shelf.
Figure 8:
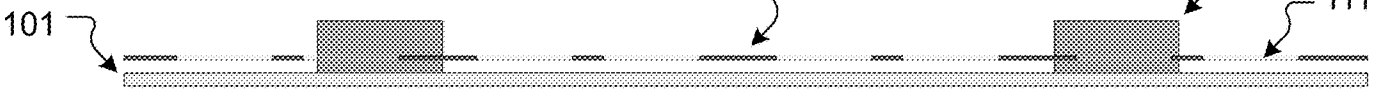
FIG. 8 is a first substrate/shelf 101 and third substrate 110 that includes cut-through channels 111.
Figure 9:
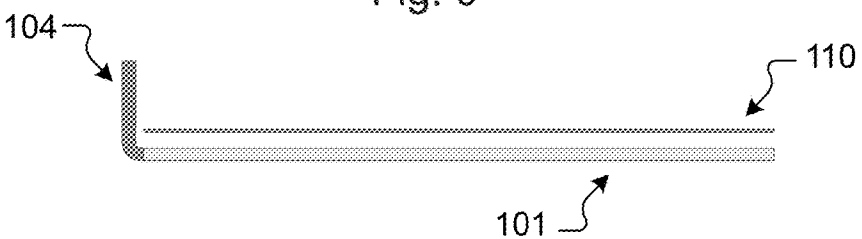
FIG. 9 is a side view of first substrate/shelf and mounted third substrate 110 on top.

Referring to FIGS. 1, 2, 3, 4 and 5 the present invention comprises a shelf/substrate 101 or shelves with integrated channels 102, 103 specifically configured for said eyewear 105 to be positioned in before and after use. The shelf 101 can include a supporting panel 109 under the shelf for stability and one or more mounted brackets 106 for slat wall or grid wall insertion. The grooves or channels can be CNC routed, molded or otherwise manufactured into the surface of said shelf. The channels may be made of continuous lines or broken into separate lines. It is desirable that the channels have a curve to fit or align to the curve of the eyewear when suitable. The channels may also be flame polished for additional finish. The shelf can be made from glass, plastics, metal or wood.

Another novel feature of the present invention describes a unique way of which said shelf or number of shelves are mounted, leveled and securely held in place by two or more tabs 104 that are a part of the shelf. These tabs become pliable through the application of heat and are bent if part of the shelf or a separately attached device needs to be altered to conform the said eyewear. These tabs are located alongside the backside-edge of the shelf. Said tabs can then be mounted into a grid wall or slat wall and securely lock the shelf into position.

Another novel feature of the present invention describes how LED lights 108 can be inserted or mounted at one or more edges of said shelf to illuminate the channels through light surface distribution to be more visible. In such event that LEDs are used it is preferable that said shelf comprises transparent plastic material. In the preferred embodiment show, the LED strip 108 is mounted within a channel 107.

Another novel feature of the present invention is a second or bottom surface lamination or mounting of additional substrate or panel to provide color or texture to said shelf and to enhance the illumination of said channels when illuminated by LED lights.

Another novel feature of the present invention is a third substrate 110, that includes multiple cut-through channels 111 and mounted on top of said first substrate to align and hold in place said eyewear.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A shelf alignment guide system, comprising:

a first substrate that includes a top surface, the top surface extending from a front edge to a back edge and from a first side edge to a second side edge;

a plurality of channels disposed on the top surface of the substrate, the plurality of channels configured to hold eyeglasses, the plurality of channels including a first channel to hold a first pair of eyeglasses and a second channel to hold a second pair of eyeglasses, the first channel and the second channel being positioned side by side along the front edge of the first substrate;

a light channel extending a distance along the back edge, the light channel running perpendicular to the back edge;

a light strip secured to the first substrate and within the light channel;

wherein the first pair of eyeglasses and the second pair of eyeglasses are positioned within the first channel and the second channel such that lenses of both the first and second pairs of eyeglasses face forward;

wherein the first and second channels are curved to align with the eyeglasses.

2. The system of claim 1, wherein the plurality of channels have curvatures to match a curvature of lenses of the eyeglasses.

3. The system of claim 1, further comprising:

one or more tabs attached to a back edge of the first substrate and configured to allow for mounting of the first substrate to a support structure.

4. The system of claim 1, further comprising:

a bracket mounted to the first substrate and configured to connect to a slat wall or grid wall.

5. The system of claim 1, wherein the first substrate is composed of one of:

a wood;

a plastic;

a metal;

a glass;

a resin; and a compressed wood.

6. The system of claim 1, wherein the light strip is an light emitting diode (LED) light strip.

7. The system of claim 1, further comprising:

a second substrate secured to the top surface of the first substrate, the second substrate configured to allow light from the light strip to pass therethrough.

8. The system of claim 7, wherein the second substrate has one or more cut through channels.

9. The system of claim 7, further comprising:

a third substrate configured to mount on a bottom surface of the first substrate.

10. The system of claim 1, wherein the one or more channels comprises:

a plurality of rows of channels, each of the plurality of rows having channels configured to receive the eyeglasses therein.

* * * * *